US011642689B2

(12) United States Patent
Tani et al.

(10) Patent No.: US 11,642,689 B2
(45) **Date of Patent: *May 9, 2023**

(54) COATING APPARATUS INCLUDING MODULAR COATING AREAS

(71) Applicant: TOYOTA JIDOSHA KABUSHIKI KAISHA, Toyota (JP)

(72) Inventors: Shinji Tani, Miyoshi (JP); Akira Numasato, Nagoya (JP); Kazuki Tanaka, Toyota (JP); Takufumi Kimura, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/357,491

(22) Filed: Jun. 24, 2021

(65) Prior Publication Data

US 2022/0001411 A1 Jan. 6, 2022

(30) Foreign Application Priority Data

Jul. 6, 2020 (JP) ..... JP2020-116590

(51) Int. Cl.

| | |
|---|---|
| ***B05B 16/60*** | (2018.01) |
| ***B05B 16/40*** | (2018.01) |
| ***B05B 16/00*** | (2018.01) |
| ***B05B 14/43*** | (2018.01) |
| ***B05B 13/04*** | (2006.01) |
| ***B05B 5/03*** | (2006.01) |

(52) U.S. Cl.

CPC ..... *B05B 13/0431* (2013.01); *B05B 5/03* (2013.01); *B05B 16/00* (2018.02); *B05B 16/40* (2018.02); *B05B 16/60* (2018.02); *B05B 14/43* (2018.02)

(58) Field of Classification Search

None

See application file for complete search history.

(56) References Cited

U.S. PATENT DOCUMENTS

| | | | | |
|---|---|---|---|---|
| 4,590,884 A * | 5/1986 | Kreeger | B05B 16/95 118/326 |
| 4,951,600 A | 8/1990 | Soshi et al. | |
| 6,226,568 B1 * | 5/2001 | Tong | B05B 16/60 454/52 |
| 2009/0277384 A1 * | 11/2009 | Spangler | B65G 43/10 118/676 |

(Continued)

FOREIGN PATENT DOCUMENTS

| | | |
|---|---|---|
| CN | 201959893 U | 9/2011 |
| CN | 108290175 A | 7/2018 |

(Continued)

*Primary Examiner* — Binu Thomas

(74) *Attorney, Agent, or Firm* — Sughrue Mion, PLLC

(57) ABSTRACT

A coating apparatus includes a first module and a second module constituting a coating area where a coating target is coated. The first module includes a first frame and a coating robot. The second module includes a second frame. When the first module and the second module are arranged to adjoin each other in a movement path direction in which the coating target relatively moves along the coating area, the first frame of the first module and the second frame of the second module that are arranged to adjoin each other are configured to be coupled together.

3 Claims, 11 Drawing Sheets

(56) References Cited

U.S. PATENT DOCUMENTS

| | | | | |
|---|---|---|---|---|
| 2011/0166708 | A1* | 7/2011 | Herre | B05B 16/40 700/258 |
| 2011/0250360 | A1* | 10/2011 | Kormoci | B05B 16/40 427/427.2 |
| 2016/0160336 | A1* | 6/2016 | Weber | B05B 16/80 118/326 |
| 2018/0347848 | A1 | 12/2018 | Takagi et al. | |
| 2019/0083994 | A1 | 3/2019 | Tani et al. | |
| 2020/0348039 | A1* | 11/2020 | Jang | B05B 13/0452 |

FOREIGN PATENT DOCUMENTS

| | | | |
|---|---|---|---|
| CN | 109590120 | A | 4/2019 |
| JP | 02-006868 | A | 1/1990 |
| JP | 2015-205228 | A | 11/2015 |

* cited by examiner

COATING APPARATUS INCLUDING MODULAR COATING AREAS

CROSS-REFERENCE TO RELATED APPLICATION

This application claims priority to Japanese Patent Application No. 2020-116590 filed on Jul. 6, 2020, incorporated herein by reference in its entirety.

BACKGROUND

1. Technical Field

The present disclosure relates to a coating apparatus and a method for installing the coating apparatus.

2. Description of Related Art

There is known a coating booth having a coating operation area (see, for example, Japanese Unexamined Patent Application Publication No. 2-6868 (JP 2-6868 A)). In this coating booth, a tunnel-shaped coating operation area is constituted by a ceiling, two side walls, and a floor. A conveyor is provided on the floor, and is configured to convey a coating target. An automatic coating machine is provided in the coating operation area. The automatic coating machine is configured to coat the conveyed coating target.

The automatic coating machine is provided on a box. The automatic coating machine and the box constitute a coating machine unit. The coating machine unit is mounted on the side of the coating booth.

The coating machine unit is preassembled separately in a factory, and is mounted on the coating booth after the coating machine unit is brought into a coating booth construction site. That is, the automatic coating machine is arranged in the coating operation area of the coating booth by mounting the box on the coating booth. Therefore, there is no need to mount the automatic coating machine itself on the coating booth at the coating booth construction site. Thus, an installation time can be shortened at the coating booth construction site.

SUMMARY

In the coating booth described above, the installation time can be shortened at the coating booth construction site. To change the size of the coating operation area, however, the overall framework of the coating booth needs to be changed. Therefore, it is difficult to change the size of the coating operation area.

The present disclosure provides a coating apparatus and a method for installing the coating apparatus, in which the size of a coating area (unit) can be changed easily.

A coating apparatus according to a first aspect of the present disclosure includes a first module and a second module. The first module constitutes a coating area where a coating target is coated. The first module includes a first frame and a coating robot. The second module constitutes the coating area where the coating target is coated. The second module includes a second frame. When the first module and the second module are arranged to adjoin each other in a movement path direction in which the coating target relatively moves along the coating area, the first frame of the first module and the second frame of the second module that are arranged to adjoin each other are configured to be coupled together.

In the coating apparatus according to the first aspect of the present disclosure, the coating apparatus is divided into the modules. Therefore, the size of the coating area (unit) can easily be changed by changing the number of modules to be coupled.

In the coating apparatus according to the first aspect of the present disclosure, a control panel configured to control the coating robot may be attached to the first module.

The coating apparatus according to the first aspect of the present disclosure may include a third module configured to be coupled to a top, a bottom, a right, or a left of the first module or the second module when viewed in a cross section orthogonal to the movement path direction.

In the coating apparatus according to the first aspect of the present disclosure, the third module may constitute at least one of an air supply module configured to supply air to the coating area or an air exhaust module configured to exhaust air from the coating area.

In the coating apparatus according to the first aspect of the present disclosure, the coating robot may include a spray gun configured to spray a coating material toward the coating target by electrostatically atomizing the coating material.

A method for installing a coating apparatus according to a second aspect of the present disclosure is a method for installing a coating apparatus at an installation place. The coating apparatus is configured to coat a coating target. The method includes forming a first module including a coating robot and a first frame. The first module constitutes a coating area where the coating target is coated. The method includes forming a second module including a second frame. The second module constitutes the coating area where the coating target is coated. The method includes transporting the first module and the second module to the installation place, arranging the first module and the second module to adjoin each other in a movement path direction in which the coating target relatively moves along the coating area, and coupling the first frame of the first module and the second frame of the second module that are arranged to adjoin each other.

According to the coating apparatus and the method for installing the coating apparatus in the present disclosure, the size of the coating area (unit) can be changed easily.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein.

DETAILED DESCRIPTION OF EMBODIMENTS

One embodiment of the present disclosure is described below.

Figure 1:
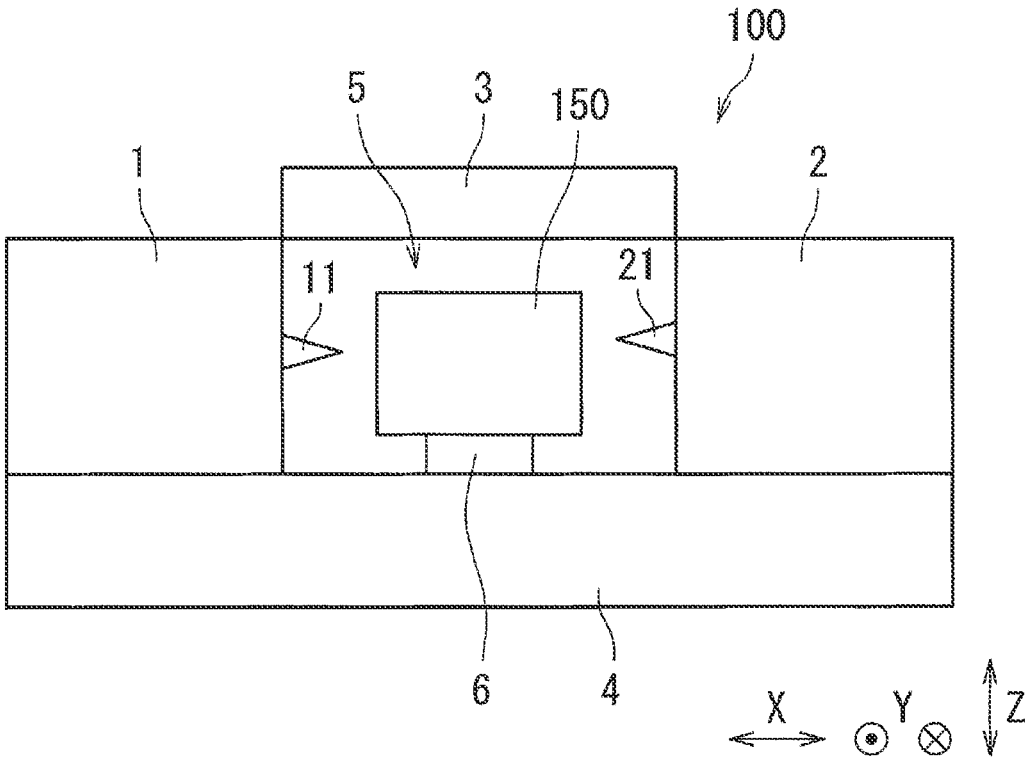
FIG. 1 is a schematic diagram illustrating a coating apparatus according to an embodiment.

First, the schematic structure of a coating apparatus 100 according to the embodiment of the present disclosure is described with reference to FIG. 1 and FIG. 2.

The coating apparatus 100 is equipment for coating a coating target 150. As illustrated in FIG. 1, the coating apparatus 100 includes side units 1 and 2, an air supply unit 3, and an air exhaust unit 4. The coating apparatus 100 has a coating area 5 for coating. In FIG. 1 or other figures, an X direction is a width direction of the coating apparatus 100, a Y direction is a length direction of the coating apparatus 100 (conveyance direction of the coating target 150), and a Z direction is a height direction of the coating apparatus 100 (vertical direction). FIG. 1 is a schematic diagram that is viewed in a cross section orthogonal to the conveyance direction of the coating target 150 (movement path direction).

The side units 1 and 2 face each other across the coating area 5, and are arranged above the air exhaust unit 4. The side unit 1 has a coating robot 11. The side unit 2 has a coating robot 21. The coating robots 11 and 21 are configured to coat the coating target 150 in the coating area 5. Examples of the coating target 150 include a body of a vehicle.

The air supply unit 3 is arranged above the coating area 5, and is configured to supply air to the coating area 5. The air supply unit 3 is provided between the side units 1 and 2, and is arranged at a higher position than those of the side units 1 and 2. The air exhaust unit 4 is arranged below the coating area 5, and is configured to exhaust air from the coating area 5. The air exhaust unit 4 has a conveyor 6. The conveyor 6 is configured to convey the coating target 150 in its conveyance direction (Y direction).

When the coating apparatus 100 coats the coating target 150, a downward air flow (downflow) from the air supply unit 3 to the air exhaust unit 4 is formed in the coating area 5. Thus, coating particles that do not adhere to the coating target 150 (overspray mist) can be discharged out of the coating area 5.

Figure 2:
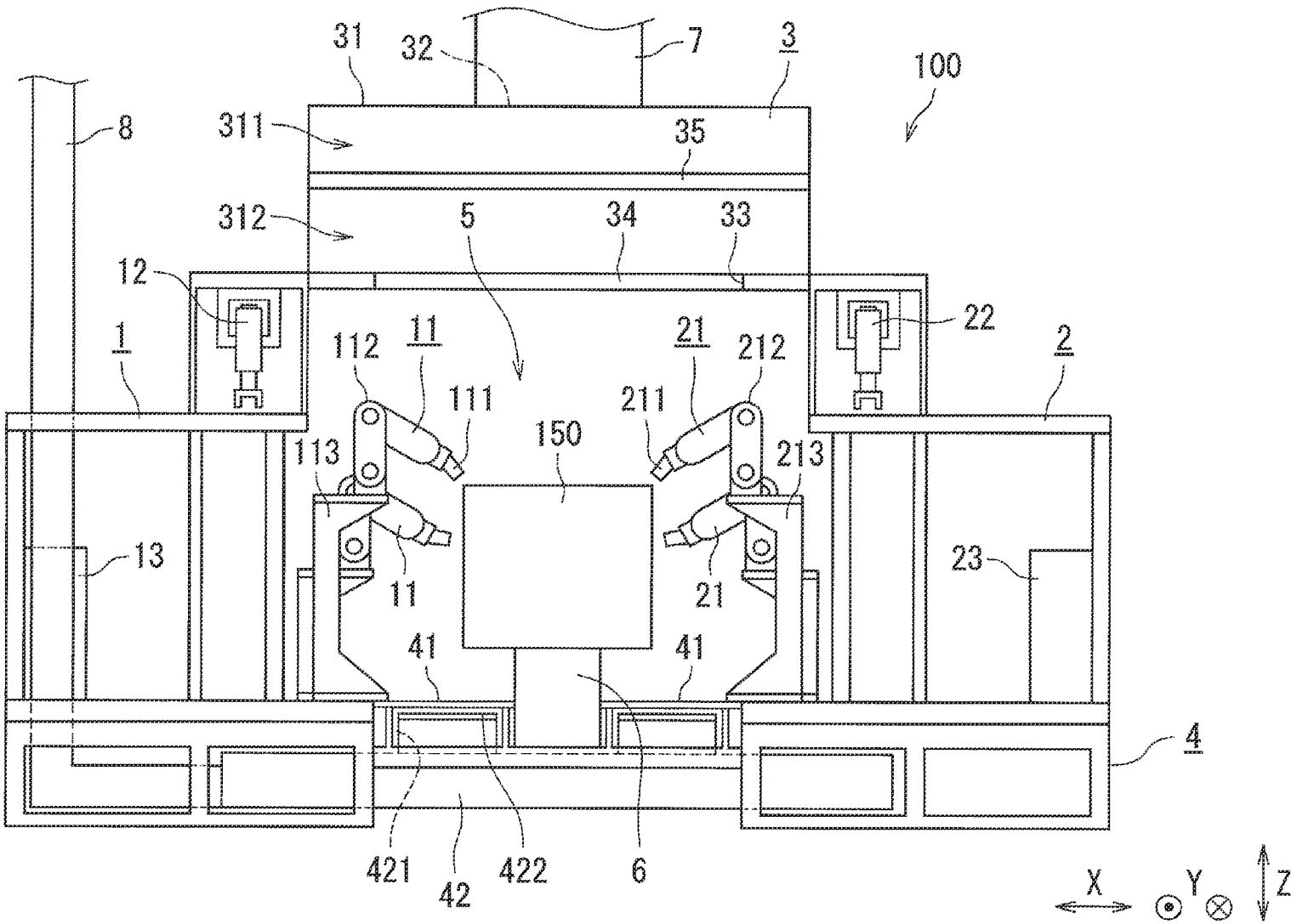
FIG. 2 is a schematic structural diagram for describing the coating apparatus of FIG. 1.

Specifically, the side unit 1 constitutes one side of the coating apparatus 100 as illustrated in FIG. 2. The side unit 1 includes two coating robots 11, an auxiliary robot 12, and a control panel 13. The coating robots 11 and the auxiliary robot 12 are arranged in the coating area 5. The control panel 13 is arranged outside the coating area 5.

The two coating robots 11 are arrayed in the conveyance direction. One coating robot 11 is arranged on an upper side with respect to the other coating robot 11. The one (upper) coating robot 11 is arranged on an inner side in the width direction with respect to the other (lower) coating robot 11. Each coating robot 11 includes a spray gun 111 configured to atomize a coating material, and a robot arm 112 configured to move the spray gun 111. A base of the robot arm 112 is attached to a post 113. Details of the spray gun 111 are described later. The control panel 13 is configured to control the coating robots 11.

The side unit 2 constitutes the other side of the coating apparatus 100. The side unit 2 includes two coating robots 21, an auxiliary robot 22, and a control panel 23. The two coating robots 21 and the auxiliary robot 22 are arranged in the coating area 5. The control panel 23 is arranged outside the coating area 5.

The two coating robots 21 face the two coating robots 11 in the width direction (X direction). The two coating robots 21 are arrayed in the conveyance direction. One coating robot 21 is arranged on an upper side with respect to the other coating robot 21. The one (upper) coating robot 21 is arranged on an inner side in the width direction with respect to the other (lower) coating robot 21. Each coating robot 21 includes a spray gun 211 configured to atomize a coating material, and a robot arm 212 configured to move the spray gun 211. A base of the robot arm 212 is attached to a post 213. The spray gun 211 is structured similarly to the spray gun 111. The control panel 23 is configured to control the coating robots 21.

The air supply unit 3 is arranged above the coating area 5, and constitutes a ceiling (upper side) in the coating area 5. The air supply unit 3 has a rectangular box-shaped air supply chamber 31. A duct connector 32 is provided on an upper side of the air supply chamber 31. An air supply duct 7 is connected to the duct connector 32. An introduction port 33 is provided on a lower side of the air supply chamber 31 to introduce air into the coating area 5. A filter 34 is attached to the introduction port 33 to remove, for example, dust in the air.

Air whose temperature and humidity are controlled flows into the air supply chamber 31 from an air conditioner (not illustrated) via the air supply duct 7. The air supply chamber 31 has a function of regulating a flow of the air from the air supply duct 7. An air volume control damper 35 is provided in an internal space of the air supply chamber 31. The air volume control damper 35 partitions the internal space of the air supply chamber 31 into an upstream space 311 and a downstream space 312. The upstream space 311 communicates with the air supply duct 7. The downstream space 312 communicates with the coating area 5 via the filter 34 at the introduction port 33. The air volume control damper 35 is provided to control the volume of air flowing from the upstream space 311 to the downstream space 312 per unit time.

The air exhaust unit 4 is arranged below the coating area 5. The conveyor 6 is provided at the center of the air exhaust unit 4 in the width direction (X direction). The air exhaust unit 4 has grid plates 41 constituting a floor (lower side) in the coating area 5, and an air exhaust chamber 42 located below the grid plates 41. The air exhaust chamber 42 has a rectangular box shape, and is configured to collect coating particles in air exhausted from the coating area 5. A plurality of exhaust ports 421 is provided in the air exhaust chamber 42. A filter 422 is attached to each exhaust port 421. The filter 422 is a thin dry filter provided to remove coating particles in air. The filter 422 removes the coating particles in the air when the air is taken into the air exhaust chamber 42 from the coating area 5 via the exhaust port 421. An air exhaust duct 8 is connected to the air exhaust chamber 42. The air exhaust chamber 42 communicates with the outside via the air exhaust duct 8.

The conveyor 6 is provided to convey the coating target 150 into and out of the coating area 5.

Spray Gun

Next, the spray gun 111 of the coating robot 11 is described with reference to FIG. 9 to FIG. 11.

Figure 11:
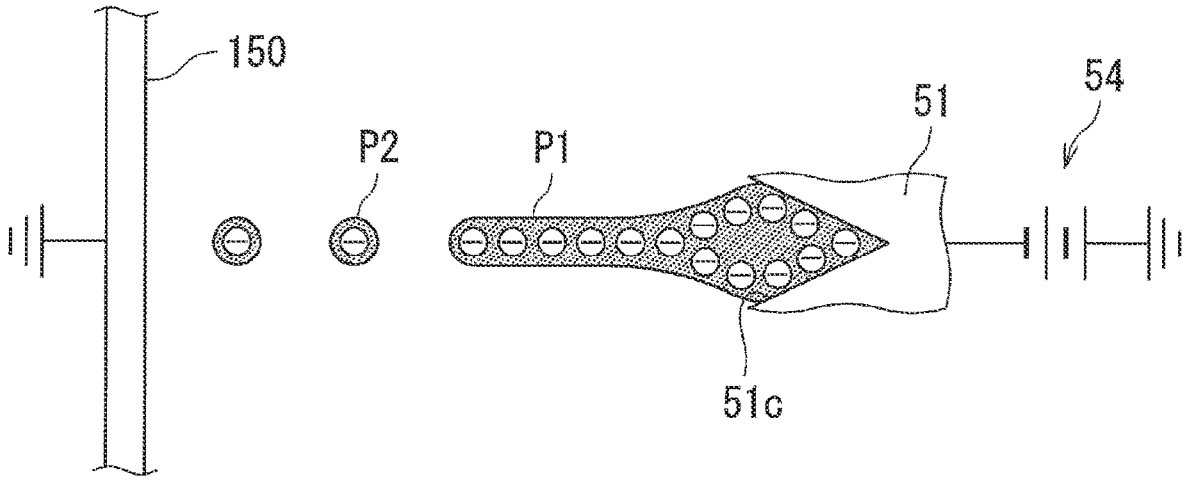
FIG. 11 is a schematic diagram for describing electrostatic atomization performed by the coating robot of FIG. 9.

As illustrated in FIG. 11, the spray gun 111 ejects a stringy coating material P1 from a rotary head 51, electrostatically atomizes the stringy coating material P1 into coating particles (atomized coating material) P2, and causes the coating particles P2 to adhere to the coating target 150.

Figure 9:
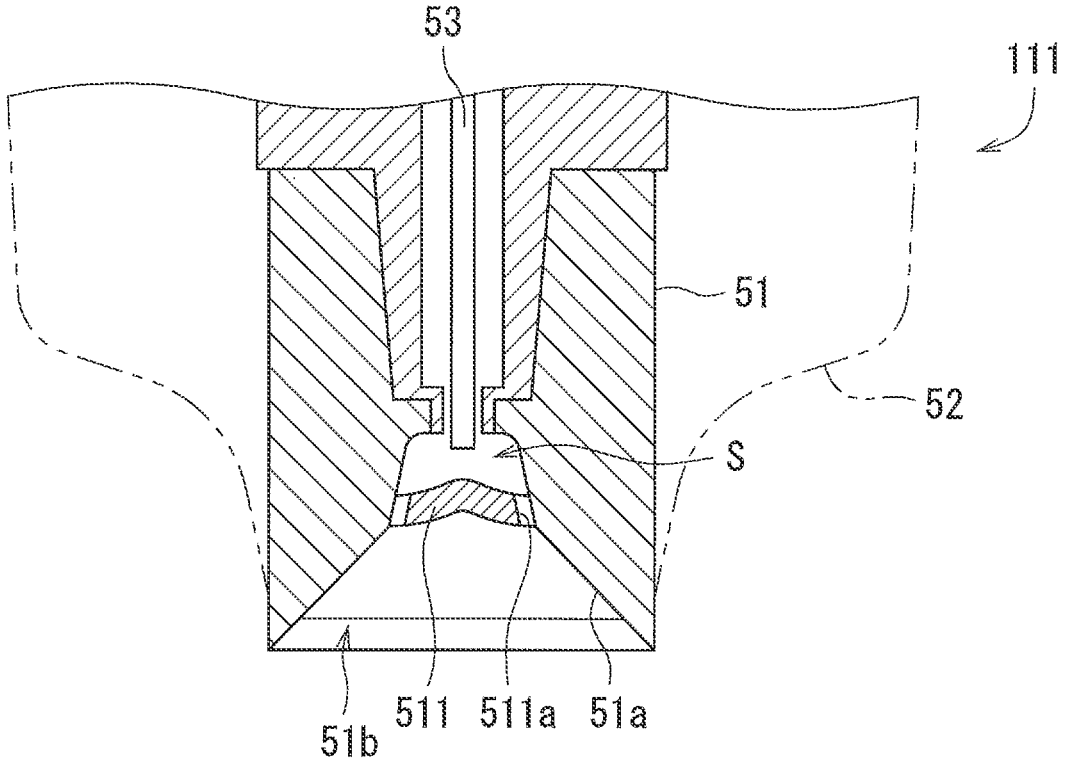
FIG. 9 is a sectional view illustrating a spray gun of a coating robot of the coating apparatus of FIG. 2.
Figure 10:
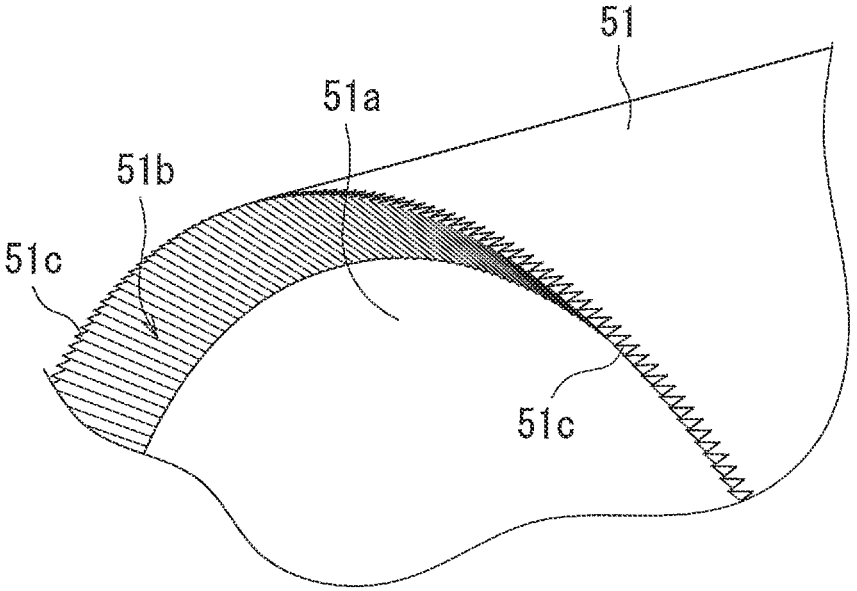
FIG. 10 is a perspective view illustrating the distal end of a rotary head of the spray gun of FIG. 9.

As illustrated in FIG. 9, the spray gun 111 includes the rotary head 51, an air motor (not illustrated), a cap 52, a coating material supply tube 53, and a voltage generator 54 (see FIG. 11). The air motor rotates the rotary head 51. The cap 52 covers the outer peripheral surface of the rotary head 51. The coating material is supplied to the rotary head 51 through the coating material supply tube 53. The voltage generator 54 applies a negative high voltage to the rotary head 51.

The rotary head 51 is configured to be supply with a liquid coating material, and eject the coating material by a centrifugal force. A coating material space S is constituted by attaching a hub 511 to the rotary head 51. The distal end of the coating material supply tube 53 is located in the coating material space S. A coating material stored in a coating material cartridge is supplied to the coating material space S through the coating material supply tube 53. A plurality of outflow ports 511*a* is formed along the outer edge of the hub 511 to cause the coating material to flow out of the coating material space S.

A diffusion surface 51*a* is formed on a radially outer side of the outflow ports 511*a* of the rotary head 51 to diffuse the coating material by a centrifugal force. The diffusion surface 51*a* has its diameter increasing toward the distal end of the rotary head 51, and is configured to form a film of the coating material after the coating material flows out through the outflow ports 511*a*. As illustrated in FIG. 10, grooves 51*c* are formed along an outer edge 51*b* of the diffusion surface 51*a* to eject the film-shaped coating material as a string. In FIG. 9, illustration of the grooves 51*c* is omitted for viewability.

A plurality of grooves 51*c* is provided in a circumferential direction and extends in a radial direction when viewed in an axial direction. That is, the grooves 51*c* are formed along the outer edge 51*b* of the diffusion surface 51*a* to extend in a direction in which the diffusion surface 51*a* is inclined. The grooves 51*c* is formed to reach a radially outer edge of the rotary head 51. Therefore, the distal end of the rotary head 51 has irregularities when viewed from the outer peripheral side.

As illustrated in FIG. 11, the stringy coating material P1 ejected from the grooves 51*c* of the rotary head 51 of the spray gun 111 is charged by applying a negative high voltage to the rotary head 51 from the voltage generator 54. The stringy coating material P1 is separated into coating particles P2 by using a repulsive force of the charge. That is, the stringy coating material P1 ejected from the grooves 51*c* of the rotary head 51 is electrostatically atomized into the coating particles P2. The coating robot 11 does not have an air discharger configured to discharge shaping air. Therefore, the coating particles P2 are formed irrespective of the shaping air. Since the coating robot 11 employs the electrostatic atomization system that does not use the shaping air, the coating particles do not rise due to the shaping air. Thus, generation of overspray mist is suppressed, and the range of the generation of the overspray mist is narrowed.

In the coating apparatus 100 (see FIG. 2) including the coating robots 11 and 21 of the electrostatic atomization system, energy consumption and $CO_2$ emission can be reduced by downsizing the coating apparatus 100. For example, the dimensions of the coating apparatus 100 illustrated in FIG. 2 are such that the width (length in the X direction) is 9 m, the height (length in the Z direction) is 5.6 m, and the length (length in the Y direction) is 4.5 m.

Modular Structure of Coating Apparatus

Figure 3:
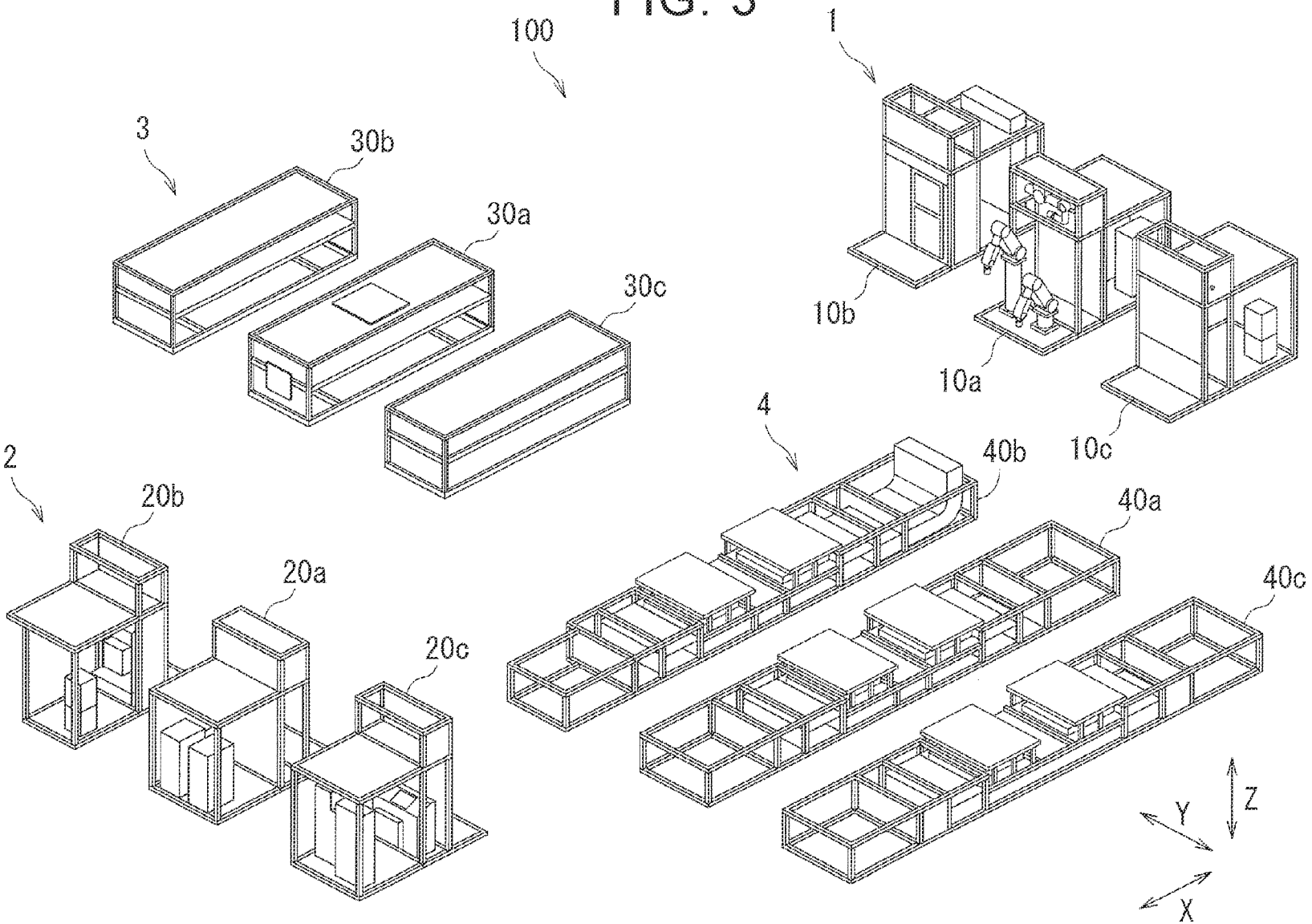
FIG. 3 is an exploded perspective view illustrating the coating apparatus of FIG. 2.

Next, a modular structure of the coating apparatus 100 according to this embodiment is described with reference to FIG. 3 to FIG. 8. The units of the coating apparatus 100 are modularized as illustrated in FIG. 3.

Side Units

Figure 4:
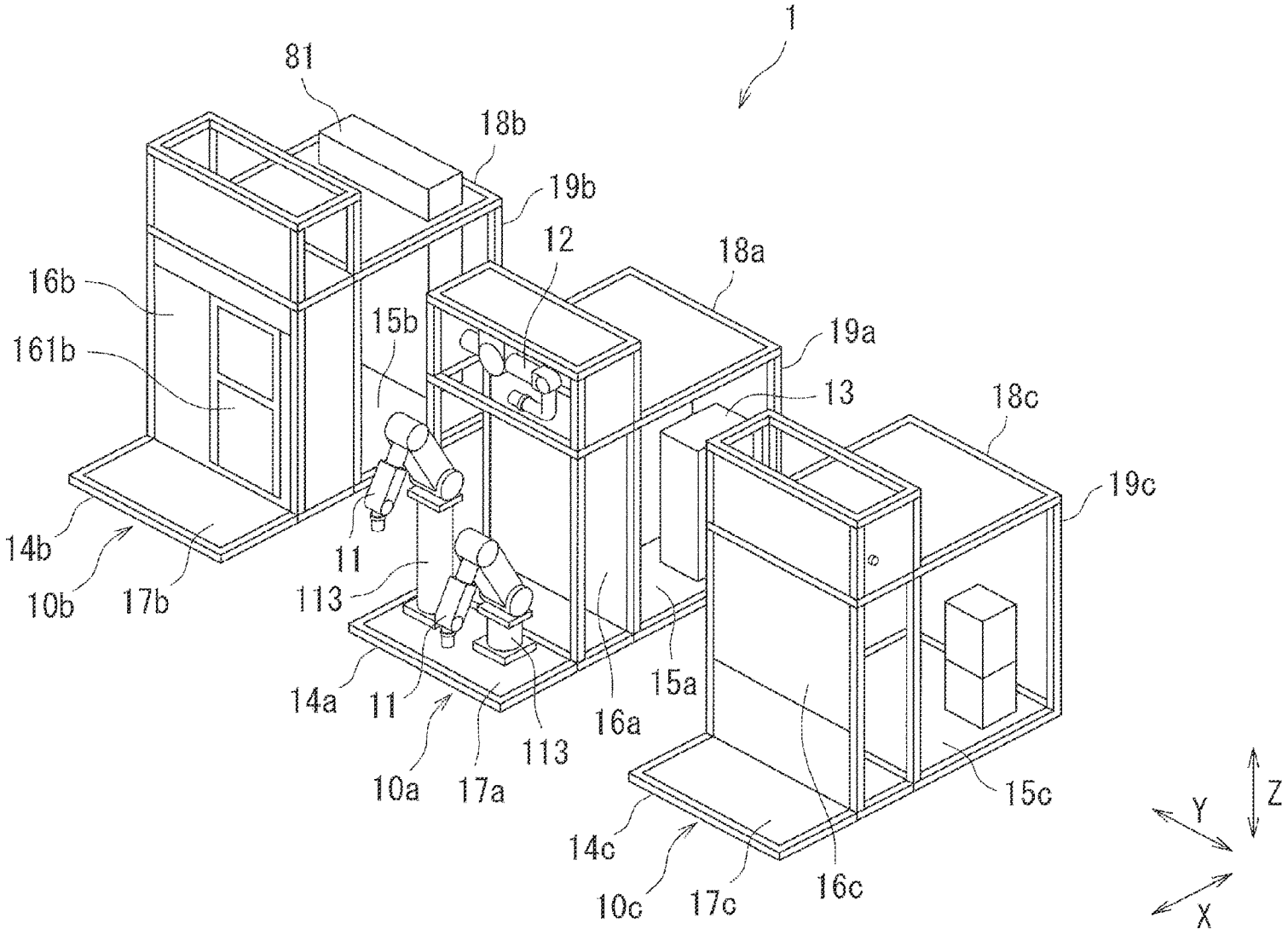
FIG. 4 is a diagram illustrating one side unit of the coating apparatus of FIG. 3.

As illustrated in FIG. 4, the side unit 1 includes three side modules 10*a* to 10*c*. The side modules 10*a* to 10*c* are configured to be coupled together when being arranged to adjoin each other in the conveyance direction of the coating target 150 (Y direction). The side unit 1 is formed by coupling the side modules 10*a* to 10*c*. The side module 10*a* is an example of "first module" of the present disclosure. The side modules 10*b* and 10*c* are examples of "second module" of the present disclosure.

The side module 10*a* is arranged between the side modules 10*b* and 10*c* when united. The side module 10*a* includes a frame (framework) 14*a*, a panel 15*a*, partition walls 16*a*, and a grid plate 17*a*. The frame 14*a* is a skeleton of the side module 10*a*, and is formed by assembling a plurality of bar-shaped members. The panel 15*a*, the partition walls 16*a*, and the grid plate 17*a* are attached to the frame 14*a*. For example, the panel 15*a* constitutes a floor outside the coating area 5. The partition walls 16*a* are partition plates that partition the coating area 5. The grid plate 17*a* constitutes the floor in the coating area 5. The frame 14*a* is an example of "first frame" of the present disclosure.

Figure 5:
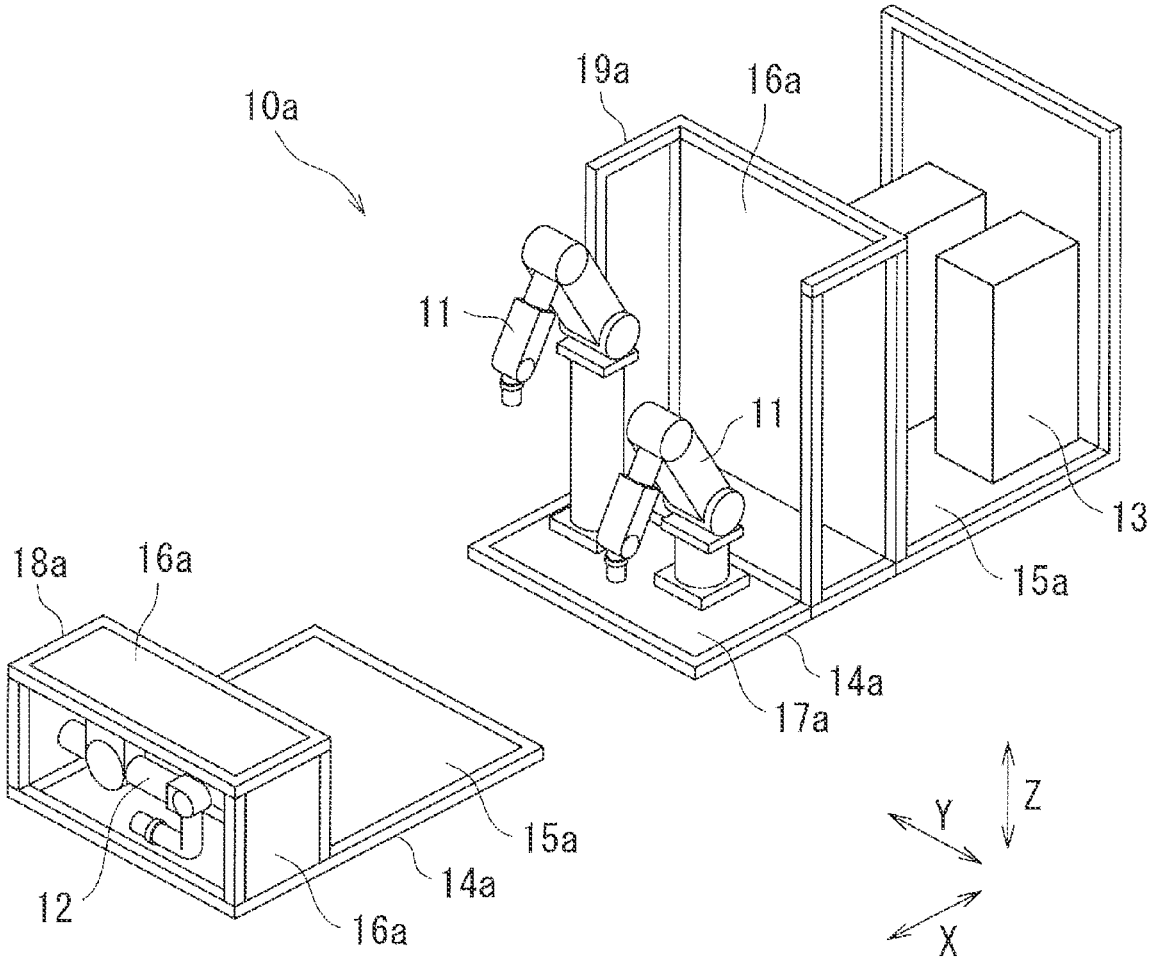
FIG. 5 is a diagram illustrating a state in which a side module of the side unit of FIG. 4 is split.

The side module 10*a* includes the two coating robots 11, the auxiliary robot 12, and the control panel 13. The post 113 of each coating robot 11 is attached to the grid plate 17*a*. The auxiliary robot 12 is attached to the partition wall 16*a*. The control panel 13 is attached to the panel 15*a*. As illustrated in FIG. 5, the side module 10*a* is splittable into an upper side module 18*a* and a lower side module 19*a*. For example, one end of an air supply module 30*a* described later (see FIG. 3) in the width direction in the air supply unit 3 is attachable to the upper end of the upper side module 18*a*.

As illustrated in FIG. 4, the side module 10*b* is arranged on one side in the conveyance direction with respect to the side module 10*a* when united. The side module 10*b* includes a frame 14*b*, a panel 15*b*, partition walls 16*b*, and a grid plate 17*b*. The frame 14*b* is a skeleton of the side module 10*b*, and is formed by assembling a plurality of bar-shaped members. The frame 14*b* is structured substantially similarly to the frame 14*a*. The panel 15*b*, the partition walls 16*b*, and the grid plate 17*b* are attached to the frame 14*b*. For example, the panel 15*b* constitutes the floor outside the coating area 5. The partition walls 16*b* are partition plates that partition the coating area 5, and have a door 161*b* for access to the coating area 5 by an operator. The partition wall 16*b* constituting the side of the coating area 5 is arranged on an inner side in the width direction with respect to the partition wall 16*a* constituting the side of the coating area 5. The grid plate 17*b* constitutes the floor in the coating area 5. The frame 14*b* is an example of "second frame" of the present disclosure.

The side module 10*b* has a duct component 81 constituting a part of the air exhaust duct 8 (see FIG. 2). The duct component 81 is arranged outside the coating area 5, and extends in the vertical direction. The side module 10*b* does not have the coating robot 11 and the like. The side module 10*b* is splittable into an upper side module 18*b* and a lower side module 19*b*. For example, one end of an air supply module 30*b* described later (see FIG. 3) in the width direction in the air supply unit 3 is attachable to the upper end of the upper side module 18*b*.

The side module 10*c* is arranged on the other side in the conveyance direction with respect to the side module 10*a* when united. The side module 10*c* includes a frame 14*c*, a panel 15*c*, partition walls 16*c*, and a grid plate 17*c*. The frame 14*c* is a skeleton of the side module 10*c*, and is formed by assembling a plurality of bar-shaped members. The frame 14*c* is structured substantially similarly to the frame 14*a*. The panel 15*c*, the partition walls 16*c*, and the grid plate 17*c* are attached to the frame 14*c*. For example, the panel 15*c* constitutes the floor outside the coating area 5. The partition walls 16*c* are partition plates that partition the coating area 5. The partition wall 16*c* constituting the side of the coating area 5 is arranged on an inner side in the width direction with respect to the partition wall 16*a* constituting the side of the coating area 5, and is arranged at a position corresponding, in the width direction, to the partition wall 16*b* constituting the side of the coating area 5. The grid plate 17*c* constitutes the floor in the coating area 5. The frame 14*c* is an example of "second frame" of the present disclosure.

The side module 10*c* does not have the coating robot 11, the duct component 81, and the like. The side module 10*c* is splittable into an upper side module 18*c* and a lower side module 19*c*. For example, one end of an air supply module 30*c* described later (see FIG. 3) in the width direction in the air supply unit 3 is attachable to the upper end of the upper side module 18*c*.

Figure 6:
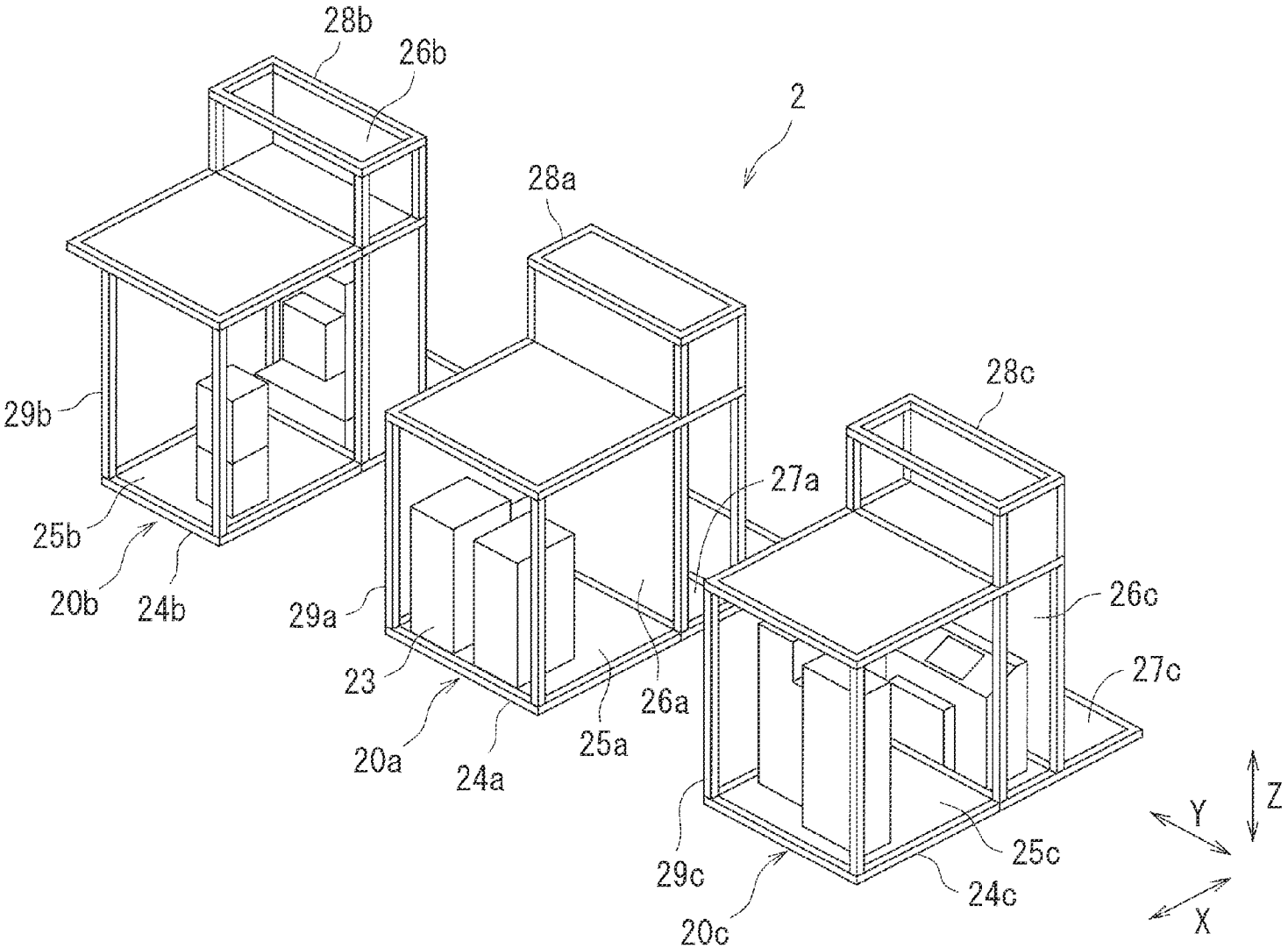
FIG. 6 is a diagram illustrating the other side unit of the coating apparatus of FIG. 3.

As illustrated in FIG. 6, the side unit 2 includes three side modules 20*a* to 20*c*. The side modules 20*a* to 20*c* are configured to be coupled together when being arranged to adjoin each other in the conveyance direction of the coating target 150 (Y direction). The side unit 2 is formed by coupling the side modules 20*a* to 20*c*. The side module 20*a* is an example of "first module" of the present disclosure. The side modules 20*b* and 20*c* are examples of "second module" of the present disclosure.

The side module 20*a* is arranged between the side modules 20*b* and 20*c* when united. The side module 20*a* includes a frame 24*a*, a panel 25*a*, partition walls 26*a*, and a grid plate 27*a*. The frame 24*a* is a skeleton of the side module 20*a*, and is formed by assembling a plurality of bar-shaped members. The panel 25*a*, the partition walls 26*a*, and the grid plate 27*a* are attached to the frame 24*a*. For example, the panel 25*a* constitutes the floor outside the coating area 5. The partition walls 26*a* are partition plates that partition the coating area 5. The grid plate 27*a* constitutes the floor in the coating area 5. The frame 24*a* is an example of "first frame" of the present disclosure.

The side module 20*a* includes the two coating robots 21 (see FIG. 2), the auxiliary robot 22 (see FIG. 2), and the control panel 23. The side module 20*a* is splittable into an upper side module 28*a* and a lower side module 29*a*. For example, the other end of the air supply module 30*a* described later in the width direction in the air supply unit 3 is attachable to the upper end of the upper side module 28*a*.

The side module 20*b* is arranged on one side in the conveyance direction with respect to the side module 20*a* when united. The side module 20*b* includes a frame 24*b*, a panel 25*b*, partition walls 26*b*, and a grid plate (not illustrated). The frame 24*b* is a skeleton of the side module 20*b*, and is formed by assembling a plurality of bar-shaped members. The frame 24*b* is structured substantially similarly to the frame 24*a*. The panel 25*b*, the partition walls 26*b*, and the grid plate are attached to the frame 24*b*. For example, the panel 25*b* constitutes the floor outside the coating area 5. The partition walls 26*b* are partition plates that partition the coating area 5, and have a door (not illustrated) for access to the coating area 5 by the operator. The partition wall 26*b* constituting the side of the coating area 5 is arranged on an inner side in the width direction with respect to the partition wall 26*a* constituting the side of the coating area 5. The grid plate constitutes the floor in the coating area 5. The frame 24*b* is an example of "second frame" of the present disclosure.

The side module 20*b* does not have the coating robot 21 and the like. The side module 20*b* is splittable into an upper side module 28*b* and a lower side module 29*b*. For example, the other end of the air supply module 30*b* described later in the width direction in the air supply unit 3 is attachable to the upper end of the upper side module 28*b*.

The side module 20*c* is arranged on the other side in the conveyance direction with respect to the side module 20*a* when united. The side module 20*c* includes a frame 24*c*, a panel 25*c*, partition walls 26*c*, and a grid plate 27*c*. The frame 24*c* is a skeleton of the side module 20*c*, and is formed by assembling a plurality of bar-shaped members. The frame 24*c* is structured substantially similarly to the frame 24*a*. The panel 25*c*, the partition walls 26*c*, and the grid plate 27*c* are attached to the frame 24*c*. For example, the panel 25*c* constitutes the floor outside the coating area 5. The partition walls 26*c* are partition plates that partition the coating area 5. The partition wall 26*c* constituting the side of the coating area 5 is arranged on an inner side in the width direction with respect to the partition wall 26*a* constituting the side of the coating area 5, and is arranged at a position corresponding, in the width direction, to the partition wall 26*b* constituting the side of the coating area 5. The grid plate 27*c* constitutes the floor in the coating area 5. The frame 24*c* is an example of "second frame" of the present disclosure.

The side module 20*c* does not have the coating robot 21 and the like. The side module 20*c* is splittable into an upper side module 28*c* and a lower side module 29*c*. For example, the other end of the air supply module 30*c* described later in the width direction in the air supply unit 3 is attachable to the upper end of the upper side module 28*c*.

Air Supply Unit

Figure 7:
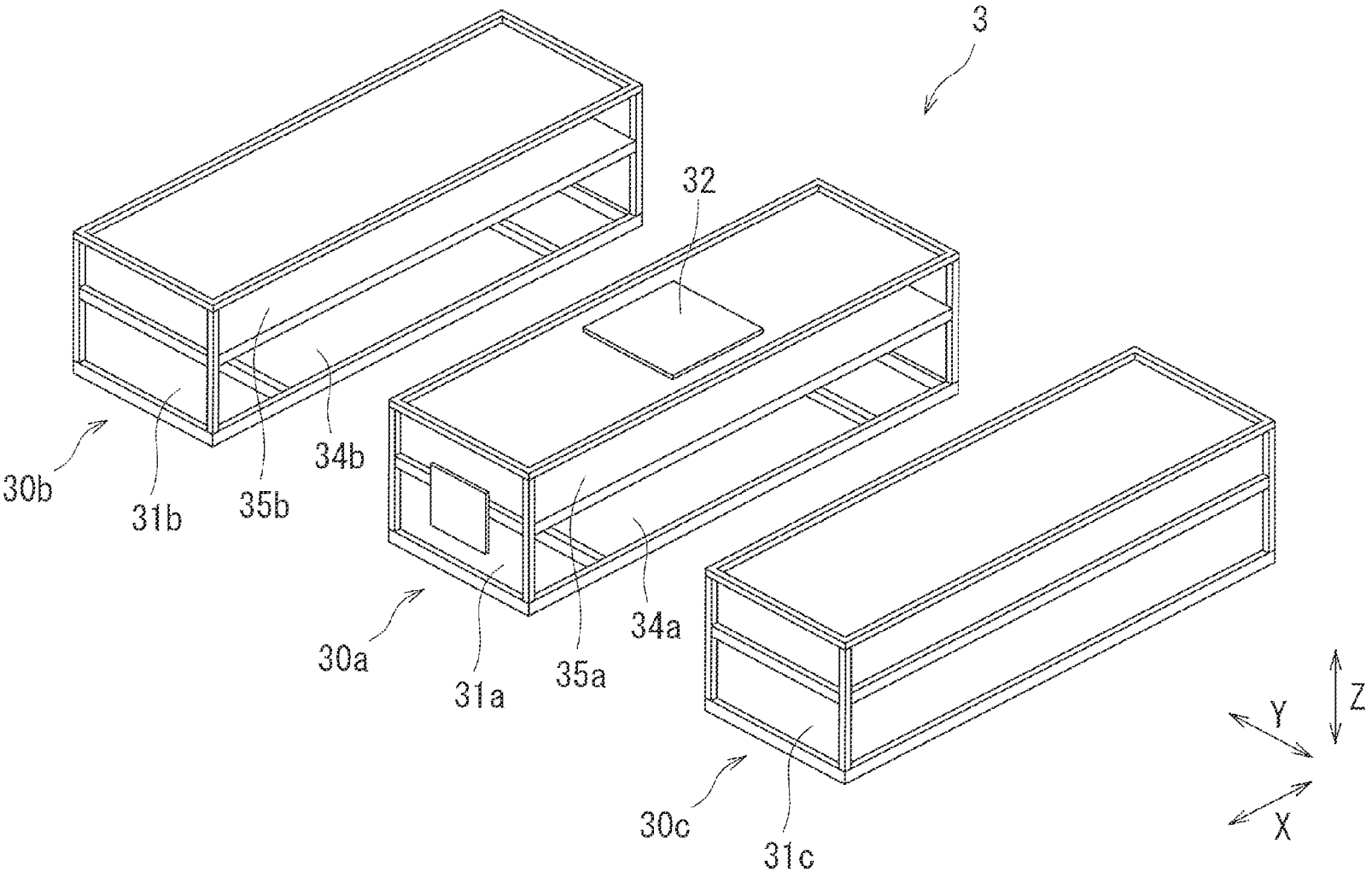
FIG. 7 is a diagram illustrating an air supply unit of the coating apparatus of FIG. 3.

As illustrated in FIG. 7, the air supply unit 3 includes three air supply modules 30*a* to 30*c*. The air supply modules 30*a* to 30*c* are configured to be coupled together when being arranged to adjoin each other in the conveyance direction of the coating target 150 (Y direction). The air supply unit 3 is formed by coupling the air supply modules 30*a* to 30*c*. The air supply modules 30*a* to 30*c* are examples of "third module" of the present disclosure.

The air supply module 30*a* is arranged between the air supply modules 30*b* and 30*c* when united. The air supply module 30*a* is an air supply chamber component 31*a* constituting a part of the air supply chamber 31 (see FIG. 2) and shaped into a rectangular tube having two open end faces in the conveyance direction. The duct connector 32 is provided on an upper side of the air supply chamber component 31*a*. A damper component 35*a* constituting the air volume control damper 35 (see FIG. 2) is provided inside the air supply chamber component 31*a*. A filter component 34*a* constituting a part of the filter 34 (see FIG. 2) is provided on a lower side of the air supply chamber component 31*a*.

The air supply module 30*b* is arranged on one side in the conveyance direction with respect to the air supply module 30*a* when united. The air supply module 30*b* is an air supply chamber component 31*b* constituting a part of the air supply chamber 31 and shaped into a bottomed rectangular tube having an open face on the other side in the conveyance direction. A damper component 35*b* constituting a part of the air volume control damper 35 is provided inside the air supply chamber component 31*b*. A filter component 34*b* constituting a part of the filter 34 is provided on a lower side of the air supply chamber component 31*b*.

The air supply module 30*c* is arranged on the other side in the conveyance direction with respect to the air supply module 30*a* when united. The air supply module 30*c* is an air supply chamber component 31*c* constituting a part of the air supply chamber 31 and shaped into a bottomed rectangular tube having an open face on one side in the conveyance direction. A damper component (not illustrated) constituting a part of the air volume control damper 35 is provided inside the air supply chamber component 31*c*. A filter component (not illustrated) constituting a part of the filter 34 is provided on a lower side of the air supply chamber component 31*c*.

Air Exhaust Unit

Figure 8:
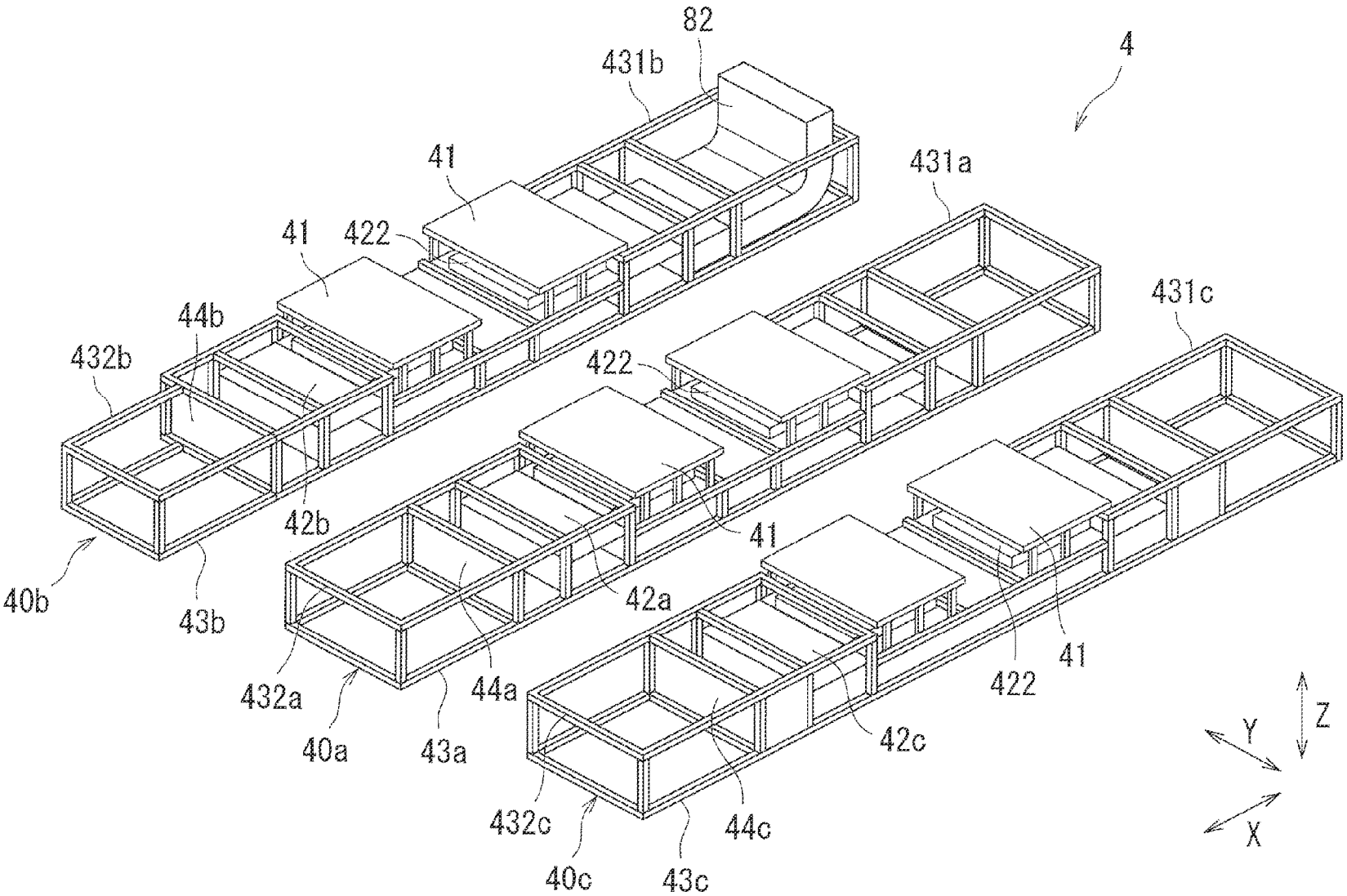
FIG. 8 is a diagram illustrating an air exhaust unit of the coating apparatus of FIG. 3.

As illustrated in FIG. 8, the air exhaust unit 4 includes three air exhaust modules 40*a* to 40*c*. The air exhaust modules 40*a* to 40*c* are configured to be coupled together when being arranged to adjoin each other in the conveyance direction of the coating target 150 (Y direction). The air exhaust unit 4 is formed by coupling the air exhaust modules 40*a* to 40*c*. The air exhaust modules 40*a* to 40*c* are examples of "third module" of the present disclosure.

The air exhaust module 40*a* is arranged between the air exhaust modules 40*b* and 40*c* when united. The air exhaust module 40*a* includes a frame 43*a* and partition walls 44*a*. The frame 43*a* is a skeleton of the air exhaust module 40*a*, and is formed by assembling a plurality of bar-shaped members. On an upper side of the frame 43*a*, a pair of grid plates 41 is attached to the center in its longitudinal direction (X direction). The grid plates 41 are arranged away from each other with a predetermined spacing, and the conveyor 6 (see FIG. 2) is arranged in this space.

An air exhaust chamber component 42*a* constituting a part of the air exhaust chamber 42 (see FIG. 2) is attached to the frame 43*a*. The air exhaust chamber component 42*a* is arranged below the grid plates 41. The filters 422 are attached to the exhaust ports 421 (see FIG. 2). The partition walls 44*a* are attached to the frame 43*a*, and are arranged on an outer side of the air exhaust chamber component 42*a*. The partition walls 44*a* are provided so that air from the coating area 5 (see FIG. 2) is taken into the air exhaust chamber 42 without flowing to the outside.

The side module 10*a* of the side unit 1 (see FIG. 3) is attachable to an upper side of one end 431*a* of the frame 43*a* in the longitudinal direction. The side module 20*a* of the side unit 2 (see FIG. 3) is attachable to an upper side of the other end 432*a* of the frame 43*a* in the longitudinal direction.

The air exhaust module 40*b* is arranged on one side in the conveyance direction with respect to the air exhaust module 40*a* when united. The air exhaust module 40*b* includes a frame 43*b* and partition walls 44*b*. The frame 43*b* is a skeleton of the air exhaust module 40*b*, and is formed by assembling a plurality of bar-shaped members. The frame 43*b* is structured substantially similarly to the frame 43*a*. On an upper side of the frame 43*b*, a pair of grid plates 41 is attached to the center in its longitudinal direction (X direction). The grid plates 41 are arranged away from each other with a predetermined spacing, and the conveyor 6 is arranged in this space.

An air exhaust chamber component 42*b* constituting a part of the air exhaust chamber 42 is attached to the frame 43*b*. The air exhaust chamber component 42*b* is arranged below the grid plates 41. The filters 422 are attached to the exhaust ports 421. The partition walls 44*b* are attached to the frame 43*b*, and are arranged on an outer side of the air exhaust chamber component 42*b*. The partition walls 44*b* are provided so that air from the coating area 5 is taken into the air exhaust chamber 42 without flowing to the outside.

The side module 10*b* of the side unit 1 (see FIG. 3) is attachable to an upper side of one end 431*b* of the frame 43*b* in the longitudinal direction. A duct component 82 constituting a part of the air exhaust duct 8 (see FIG. 2) is provided at the one end 431*b* of the frame 43*b*. The duct component 82 is configured to connect the duct component 81 of the side module 10*b* (see FIG. 4) and the air exhaust chamber component 42*b* when the coating apparatus 100 is installed. The side module 20*b* of the side unit 2 (see FIG. 3) is attachable to an upper side of the other end 432*b* of the frame 43*b* in the longitudinal direction.

The air exhaust module 40*c* is arranged on the other side in the conveyance direction with respect to the air exhaust module 40*a* when united. The air exhaust module 40*c* includes a frame 43*c* and partition walls 44*c*. The frame 43*c* is a skeleton of the air exhaust module 40*c*, and is formed by assembling a plurality of bar-shaped members. The frame 43*c* is structured substantially similarly to the frame 43*a*. On an upper side of the frame 43*c*, a pair of grid plates 41 is attached to the center in its longitudinal direction (X direction). The grid plates 41 are arranged away from each other with a predetermined spacing, and the conveyor 6 is arranged in this space.

An air exhaust chamber component 42*c* constituting a part of the air exhaust chamber 42 is attached to the frame 43*c*. The air exhaust chamber component 42*c* is arranged below the grid plates 41. The filters 422 are attached to the exhaust ports 421. The partition walls 44*c* are attached to the frame 43*c*, and are arranged on an outer side of the air exhaust chamber component 42*c*. The partition walls 44*c* are provided so that air from the coating area 5 is taken into the air exhaust chamber 42 without flowing to the outside.

The side module 10*c* of the side unit 1 (see FIG. 3) is attachable to an upper side of one end 431*c* of the frame 43*c* in the longitudinal direction. The side module 20*c* of the side unit 2 (see FIG. 3) is attachable to an upper side of the other end 432*c* of the frame 43*c* in the longitudinal direction.

Method for Installing Coating Apparatus

Next, an example of a method for installing the coating apparatus 100 according to this embodiment is described with reference to FIG. 2 to FIG. 8.

First, modules of individual units are produced in a production factory (not illustrated) of the coating apparatus 100. That is, the side modules 10*a* to 10*c* of the side unit 1, the side modules 20*a* to 20*c* of the side unit 2, the air supply modules 30*a* to 30*c* of the air supply unit 3, and the air exhaust modules 40*a* to 40*c* of the air exhaust unit 4 are produced as illustrated in FIG. 3.

Specifically, the frame 14*a* is formed by assembling a plurality of bar-shaped members as illustrated in FIG. 4. Then, the panel 15*a*, the partition walls 16*a*, the grid plate 17*a*, and the like are attached to the frame 14*a*. The coating robots 11 are attached to the grid plate 17*a*. The auxiliary robot 12 is attached to the partition wall 16*a*. The control panel 13 is attached to the panel 15*a*. That is, the coating robots 11, the auxiliary robot 12, and the control panel 13 are attached to the frame 14*a*. The coating robots 11 and the control panel 13 are connected by wiring (not illustrated). Thus, the side module 10*a* is produced. For example, the dimensions of the side module 10*a* are such that the length in a longitudinal direction (length in the X direction) is 3 m, the length in a transverse direction (length in the Y direction) is 1.5 m, and the height (length in the Z direction) is 3.2 m. When the side module 10*a* is split as illustrated in FIG. 5, the height of the upper side module 18*a* is 0.95 m, and the height of the lower side module 19*a* is 2.25 m.

As illustrated in FIG. 4, the frame 14*b* is formed by assembling a plurality of bar-shaped members. Then, the panel 15*b*, the partition walls 16*b*, the grid plate 17*b*, and the like are attached to the frame 14*b*. The duct component 81 is also attached to the frame 14*b*. Thus, the side module 10*b* is produced. For example, the dimensions of the side module 10*b* are equal to the dimensions of the side module 10*a*.

The frame 14*c* is formed by assembling a plurality of bar-shaped members. Then, the panel 15*c*, the partition walls 16*c*, the grid plate 17*c*, and the like are attached to the frame 14*c*. Thus, the side module 10*c* is produced. For example, the dimensions of the side module 10*c* are equal to the dimensions of the side module 10*a*.

As illustrated in FIG. 6, the frame 24*a* is formed by assembling a plurality of bar-shaped members. Then, the panel 25*a*, the partition walls 26*a*, the grid plate 27*a*, and the like are attached to the frame 24*a*. The coating robots 21 (see FIG. 2) are attached to the grid plate 27*a*. The auxiliary robot 22 (see FIG. 2) is attached to the partition wall 26*a*. The control panel 23 is attached to the panel 25*a*. That is, the coating robots 21, the auxiliary robot 22, and the control panel 23 are attached to the frame 24*a*. The coating robots 21 and the control panel 23 are connected by wiring (not illustrated). Thus, the side module 20*a* is produced. For example, the dimensions of the side module 20*a* are equal to the dimensions of the side module 10*a*.

The frame 24*b* is formed by assembling a plurality of bar-shaped members. Then, the panel 25*b*, the partition walls 26*b*, the grid plate (not illustrated), and the like are attached to the frame 24*b*. Thus, the side module 20*b* is produced. For example, the dimensions of the side module 20*b* are equal to the dimensions of the side module 10*a*.

The frame 24*c* is formed by assembling a plurality of bar-shaped members. Then, the panel 25*c*, the partition walls 26*c*, the grid plate 27*c*, and the like are attached to the frame 24*c*. Thus, the side module 20*c* is produced. For example, the dimensions of the side module 20*c* are equal to the dimensions of the side module 10*a*.

The air supply chamber component 31*a* shaped into a rectangular tube is formed as illustrated in FIG. 7. The duct connector 32 is provided on the upper side of the air supply chamber component 31*a*. The damper component 35*a* is provided inside the air supply chamber component 31*a*. The filter component 34*a* is provided on the lower side of the air supply chamber component 31*a*. Thus, the air supply module 30*a* is produced. For example, the dimensions of the air supply module 30*a* are such that the length in a longitudinal direction (length in the X direction) is 4.5 m, the length in a transverse direction (length in the Y direction) is 1.5 m, and the height (length in the Z direction) is 1.4 m.

The air supply chamber component 31*b* shaped into a bottomed rectangular tube is formed. The damper component 35*b* is provided inside the air supply chamber component 31*b*. The filter component 34*b* is provided on the lower side of the air supply chamber component 31*b*. Thus, the air supply module 30*b* is produced. For example, the dimensions of the air supply module 30*b* are equal to the dimensions of the air supply module 30*a*.

The air supply chamber component 31*c* shaped into a bottomed rectangular tube is formed. The damper component (not illustrated) is provided inside the air supply chamber component 31*c*. The filter component (not illustrated) is provided on the lower side of the air supply chamber component 31*c*. Thus, the air supply module 30*c* is produced. For example, the dimensions of the air supply module 30*c* are equal to the dimensions of the air supply module 30*a*.

As illustrated in FIG. 8, the frame 43*a* is formed by assembling a plurality of bar-shaped members. Then, the air exhaust chamber component 42*a*, the grid plates 41, the partition walls 44*a*, and the like are attached to the frame 43*a*. Thus, the air exhaust module 40*a* is produced. For example, the dimensions of the air exhaust module 40*a* are such that the length in a longitudinal direction (length in the X direction) is 9 m, the length in a transverse direction (length in the Y direction) is 1.5 m, and the height (length in the Z direction) is 1 m.

The frame 43*b* is formed by assembling a plurality of bar-shaped members. Then, the air exhaust chamber component 42*b*, the grid plates 41, the duct component 82, the partition walls 44*b*, and the like are attached to the frame 43*b*. Thus, the air exhaust module 40*b* is produced. For example, the dimensions of the air exhaust module 40*b* are equal to the dimensions of the air exhaust module 40*a*.

The frame 43*c* is formed by assembling a plurality of bar-shaped members. Then, the air exhaust chamber component 42*c*, the grid plates 41, the partition walls 44*c*, and the like are attached to the frame 43*c*. Thus, the air exhaust module 40*c* is produced. For example, the dimensions of the air exhaust module 40*c* are equal to the dimensions of the air exhaust module 40*a*.

As described above, the lengths of the side modules 10*a* to 10*c* and 20*a* to 20*c*, the air supply modules 30*a* to 30*c*, and the air exhaust modules 40*a* to 40*c* in the transverse direction are set equal to each other.

Next, the modules produced in the production factory are transported to a predetermined installation place. Description is given below about an example of a case where the modules are transported while being housed in containers, and an example of a case where the modules are transported while being loaded on trucks.

Housing in Containers

The side module 10*a* is split into the upper side module 18*a* and the lower side module 19*a*. Then, the upper side module 18*a* and the lower side module 19*a* are housed in a 20-feet container (not illustrated). The coating robots 11 and the control panel 13 are mounted on the housed lower side module 19*a*. The auxiliary robot 12 is mounted on the housed upper side module 18*a*.

Similarly to the side module 10*a*, each of the side modules 10*b*, 10*c*, and 20*a* to 20*c* is split and housed in a 20-feet container. Each of the air supply modules 30*a* to 30*c* is housed in a 20-feet container. The air exhaust modules 40*a* and 40*b* are housed in a 40-feet container (not illustrated)

while being stacked in two layers. The air exhaust module 40*c* is housed in a 40-feet container.

Thus, the coating apparatus 100 is transported while the modules are housed in the nine 20-feet containers and the two 40-feet containers.

Loading on Trucks

Each of the side modules 10*a* to 10*c* and 20*a* to 20*c* is split into the upper side module and the lower side module.

Three lower side modules 19*a* to 19*c* are loaded on one truck (not illustrated). The loaded lower side modules 19*a* to 19*c* are arrayed in a fore-and-aft direction of the vehicle with their longitudinal directions corresponding to the fore-and-aft direction of the vehicle. The coating robots 11 and the control panel 13 are mounted on the loaded lower side module 19*a*.

Three lower side modules 29*a* to 29*c* are loaded on one truck. The loaded lower side modules 29*a* to 29*c* are arrayed in a fore-and-aft direction of the vehicle with their longitudinal directions corresponding to the fore-and-aft direction of the vehicle. The coating robots 21 and the control panel 23 are mounted on the loaded lower side module 29*a*.

Six upper side modules 18*a* to 18*c* and 28*a* to 28*c* are loaded on one truck. The loaded upper side modules 18*a* to 18*c* and 28*a* to 28*c* are arrayed in a fore-and-aft direction of the vehicle with their longitudinal directions corresponding to a vehicle width direction. The auxiliary robot 12 is mounted on the loaded upper side module 18*a*. The auxiliary robot 22 is mounted on the loaded upper side module 28*a*.

Two air supply modules 30*a* and 30*b* are loaded on one truck. The loaded air supply modules 30*a* and 30*b* are arrayed in a fore-and-aft direction of the vehicle with their longitudinal directions corresponding to the fore-and-aft direction of the vehicle. One air supply module 30*c* is loaded on one truck together with other accessories (not illustrated).

Three air exhaust modules 40*a* to 40*c* are loaded on one truck. The loaded air exhaust modules 40*a* to 40*c* are arranged with their longitudinal directions corresponding to a fore-and-aft direction of the vehicle. Two out of the three air exhaust modules are arranged to adjoin each other in a vehicle width direction, and the remaining one air exhaust module is stacked on the two air exhaust modules. That is, the three air exhaust modules 40*a* to 40*c* are stacked in two layers, two out of the three are arranged in the lower layer, and the remaining one is arranged in the upper layer.

Thus, the coating apparatus 100 is transported by using the six trucks.

Next, the coating apparatus 100 is installed at the predetermined installation place by assembling the modules transported to the predetermined installation place.

Specifically, as illustrated in FIG. 8, the air exhaust modules 40*a* to 40*c* are arranged to adjoin each other in the conveyance direction (Y direction) of the coating target 150 (see FIG. 2) with their transverse directions corresponding to the conveyance direction (Y direction). Then, the frame 43*a* of the air exhaust module 40*a* and the frame 43*b* of the air exhaust module 40*b* that are arranged to adjoin each other are coupled together, and the frame 43*a* of the air exhaust module 40*a* and the frame 43*c* of the air exhaust module 40*c* that are arranged to adjoin each other are coupled together. Therefore, the air exhaust unit 4 is assembled at the installation place. At this time, the air exhaust chamber 42 (see FIG. 2) is constituted by the air exhaust chamber components 42*a* to 42*c*. The air exhaust chamber 42 is surrounded by the partition walls 44*a* to 44*c*.

As illustrated in FIG. 4, the upper side module 18*a* and the lower side module 19*a* are joined together. The upper side module 18*b* and the lower side module 19*b* are joined together. The upper side module 18*c* and the lower side module 19*c* are joined together. Next, the side modules 10*a* to 10*c* are arranged to adjoin each other in the conveyance direction of the coating target 150 (Y direction) with their transverse directions corresponding to the conveyance direction (Y direction). Then, the frame 14*a* of the side module 10*a* and the frame 14*b* of the side module 10*b* that are arranged to adjoin each other are coupled together, and the frame 14*a* of the side module 10*a* and the frame 14*c* of the side module 10*c* that are arranged to adjoin each other are coupled together. Therefore, the side unit 1 is assembled at the predetermined installation place.

As illustrated in FIG. 6, the upper side module 28*a* and the lower side module 29*a* are joined together. The upper side module 28*b* and the lower side module 29*b* are joined together. The upper side module 28*c* and the lower side module 29*c* are joined together. Next, the side modules 20*a* to 20*c* are arranged to adjoin each other in the conveyance direction of the coating target 150 (Y direction) with their transverse directions corresponding to the conveyance direction (Y direction). Then, the frame 24*a* of the side module 20*a* and the frame 24*b* of the side module 20*b* that are arranged to adjoin each other are coupled together, and the frame 24*a* of the side module 20*a* and the frame 24*c* of the side module 20*c* that are arranged to adjoin each other are coupled together. Therefore, the side unit 2 is assembled at the predetermined installation place.

As illustrated in FIG. 7, the air supply modules 30*a* to 30*c* are arranged to adjoin each other in the conveyance direction of the coating target 150 (Y direction) with their transverse directions corresponding to the conveyance direction (Y direction). Then, the air supply modules 30*a* and 30*b* that are arranged to adjoin each other are coupled together, and the air supply modules 30*a* and 30*c* that are arranged to adjoin each other are coupled together. Therefore, the air supply unit 3 is assembled at the predetermined installation place. That is, the air supply chamber 31 (see FIG. 2) is constituted by coupling the air supply chamber components 31*a* to 31*c*. At this time, the air volume control damper 35 (see FIG. 2) is formed inside the air supply chamber 31, and the filter 34 (see FIG. 2) is formed on the lower side of the air supply chamber 31.

Next, on the upper side of the air exhaust unit 4, the side unit 1 is assembled at one end in the width direction (X direction), the side unit 2 is assembled at the other end in the width direction, and the conveyor 6 is provided at the center in the width direction as illustrated in FIG. 2. Then, the air supply unit 3 is assembled at the upper ends of the side units 1 and 2. In this manner, the coating apparatus 100 having the coating area 5 is installed at the predetermined installation place.

For example, the coating area 5 may be constituted by the lower side of the air supply chamber 31, the partition walls 16*a* to 16*c* of the side unit 1, the partition walls 26*a* to 26*c* of the side unit 2, the grid plates 17*a* to 17*c* of the side unit 1, the grid plates 27*a* to 27*c* of the side unit 2, and the grid plates 41 of the air exhaust unit 4. The width of the coating area 5 between the side modules 10*b* and 20*b* (length in the X direction) and the width of the coating area 5 between the side modules 10*c* and 20*c* are smaller than the width of the coating area 5 between the side modules 10*a* and 20*a* because the coating robots 11 and 21 and the auxiliary robots 12 and 22 are not provided. Air flowing downward from the coating area 5 via the grid plates 17*a* to 17*c*, 27*a* to 27*c*, and 41 is taken into the air exhaust chamber 42 by the partition walls 44*a* to 44*c* without flowing to the outside.

Effects

In this embodiment, the side unit 1 is constituted by the side modules 10*a* to 10*c* as described above. Therefore, the size of the coating area 5 (side unit) can easily be changed by changing the number of side modules to be coupled. The side unit 1 is assembled at the installation place by transporting the side modules 10*a* to 10*c* to the installation place and then coupling the side modules 10*a* to 10*c*. Therefore, there is no need to mount the coating robots on the frame at the installation place. Thus, the installation time can be shortened at the installation place. The same holds true for the side unit 2.

In this embodiment, the control panel 13 is attached to the frame 14*a* in the production factory. Therefore, the installation time can be shortened at the installation place. Further, the operations of the coating robots 11 can be checked in the production factory. The same holds true for the side unit 2.

In this embodiment, the air supply unit 3 is constituted by the air supply modules 30*a* to 30*c*. Therefore, transportation can be facilitated, and the size of the coating area 5 (air supply unit) can be changed easily. Further, the air exhaust unit 4 is constituted by the air exhaust modules 40*a* to 40*c*. Therefore, transportation can be facilitated, and the size of the coating area 5 (air exhaust unit) can be changed easily.

In this embodiment, the lengths of the modules in the transverse direction are set equal to each other. Therefore, the numbers of modules of the individual units can be set equal to each other, and the length of the coating area 5 in the conveyance direction can be changed easily.

In this embodiment, the coating robots 11 and 21 employ the electrostatic atomization system. Therefore, the coating area 5 can be downsized. Thus, energy consumption and $CO_2$ emission can be reduced.

In this embodiment, the panel 15*a*, the partition walls 16*a*, the grid plate 17*a*, and the like are attached to the frame 14*a* in the production factory. Therefore, the installation time can be shortened at the installation place. The same holds true for the side modules 10*b*, 10*c*, and 20*a* to 20*c*.

In this embodiment, the grid plates 41, the air exhaust chamber component 42*a*, the partition walls 44*a*, and the like are attached to the frame 43*a* in the production factory. Therefore, the installation time can be shortened at the installation place. The same holds true for the air exhaust modules 40*b* and 40*c*.

In this embodiment, the side module 10*a* has the coating robots 11, whereas the side modules 10*b* and 10*c* do not have the coating robots 11. Therefore, the side module 10*a* and the side modules 10*b* and 10*c* have different functions. However, the side module 10*a* and the side modules 10*b* and 10*c* can easily be attached together because the frames 14*a* to 14*c* are common. The same holds true for the side unit 2.

In this embodiment, the width of the coating area 5 between the side modules 10*b* and 20*b* and the width of the coating area 5 between the side modules 10*c* and 20*c* are reduced. Therefore, the coating area 5 can be downsized. Thus, energy consumption and $CO_2$ emission can be reduced.

In this embodiment, the side module 10*a* is splittable into the upper side module 18*a* and the lower side module 19*a*. Therefore, transportation can be facilitated. The same holds true for the side modules 10*b*, 10*c*, and 20*a* to 20*c*.

In this embodiment, the coating robots 11 and 21 face each other in the width direction (X direction). Therefore, the coating area 5 can be downsized. Thus, energy consumption and $CO_2$ emission can be reduced.

In this embodiment, the side module 10*a* has the two coating robots 11, and the side module 20*a* has the two coating robots 21. Therefore, the coating area 5 can be downsized. Thus, energy consumption and $CO_2$ emission can be reduced.

In this embodiment, the side units 1 and 2 are assembled on the air exhaust unit 4. Therefore, the side units 1 and 2 facing each other can be positioned easily.

Other Embodiments

The embodiment disclosed herein is illustrative in all respects, and is not the basis for limitative interpretation. The technical scope of the present disclosure is not interpreted based on the above embodiment alone, but is defined based on the description of the claims. The technical scope of the present disclosure encompasses meanings of equivalents to the elements in the claims and all modifications within the scope of the claims.

For example, the embodiment described above is directed to the example in which the coating target 150 is a body of a vehicle. The present disclosure is not limited to this example. For example, the coating target may be a bumper of a vehicle.

The embodiment described above is directed to the example in which the side unit 1 is constituted by the three side modules 10*a* to 10*c*. The present disclosure is not limited to this example. The side unit may be constituted by two, four, or more side modules. The same holds true for the side unit 2, the air supply unit 3, and the air exhaust unit 4.

The embodiment described above is directed to the example in which one side module 10*a* has the two coating robots 11. The present disclosure is not limited to this example. One side module may have one, three, or more coating robots. The same holds true for the side unit 2.

The embodiment described above is directed to the example in which the coating robots 11 are provided only in the side module 10*a* among the three side modules 10*a* to 10*c*. The present disclosure is not limited to this example. The coating robots may be provided in a plurality of side modules. The same holds true for the side unit 2.

The embodiment described above is directed to the example in which the lengths of the side modules 10*a* to 10*c* and 20*a* to 20*c*, the air supply modules 30*a* to 30*c*, and the air exhaust modules 40*a* to 40*c* in the transverse direction are set equal to each other. The present disclosure is not limited to this example. The lengths of the side modules, the air supply modules, and the air exhaust modules in the transverse direction may differ from each other. In this case, the modules having different lengths can easily be combined and installed when modules other than a module having the shortest length in the transverse direction have lengths in the transverse direction that are equal to integral multiples of the shortest length in the transverse direction.

The embodiment described above is directed to the example in which the side module 10*a* is split into the upper side module 18*a* and the lower side module 19*a* when transported. The present disclosure is not limited to this example. The side module need not be split when transported. The same holds true for the side modules 10*b*, 10*c*, and 20*a* to 20*c*.

Figure 12:
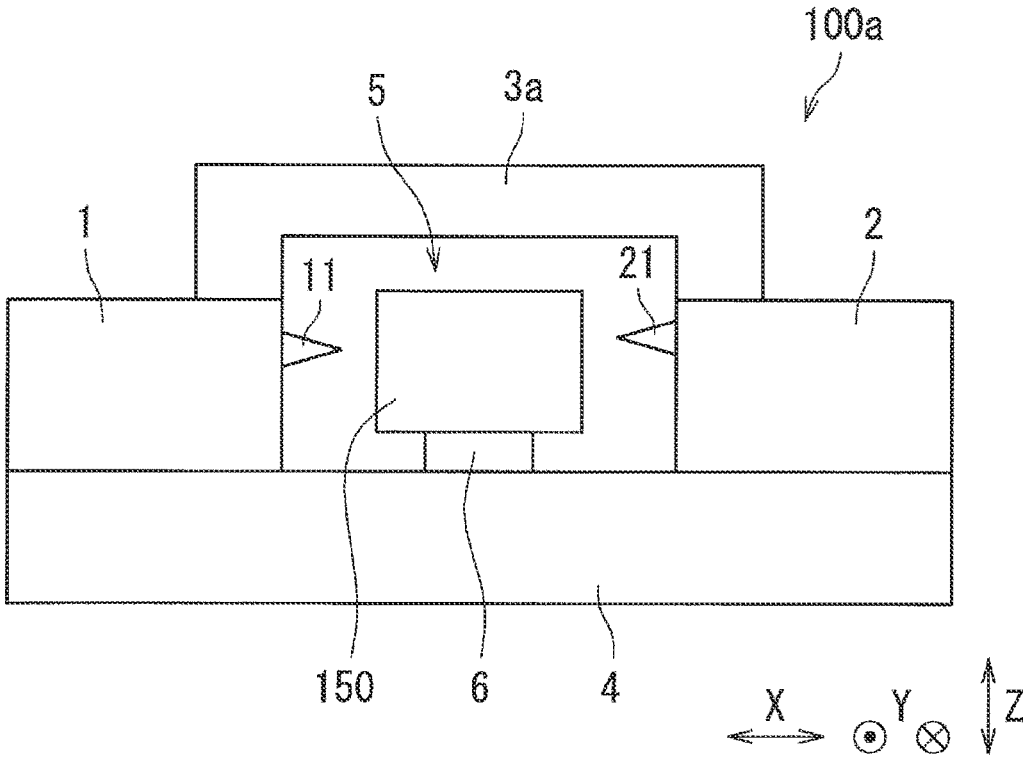
FIG. 12 is a schematic diagram illustrating a coating apparatus according to a first modified example of the embodiment.

The embodiment described above is directed to the example in which the air supply unit 3 is arranged between the side units 1 and 2. The present disclosure is not limited to this example. As in a coating apparatus 100*a* of a first modified example illustrated in FIG. 12, an air supply unit 3*a* may be attached to the upper sides of the side units 1 and 2. That is, the width of the air supply unit 3*a* (length in the X direction) may be larger than the width of the coating area 5 (length in the X direction).

Figure 13:
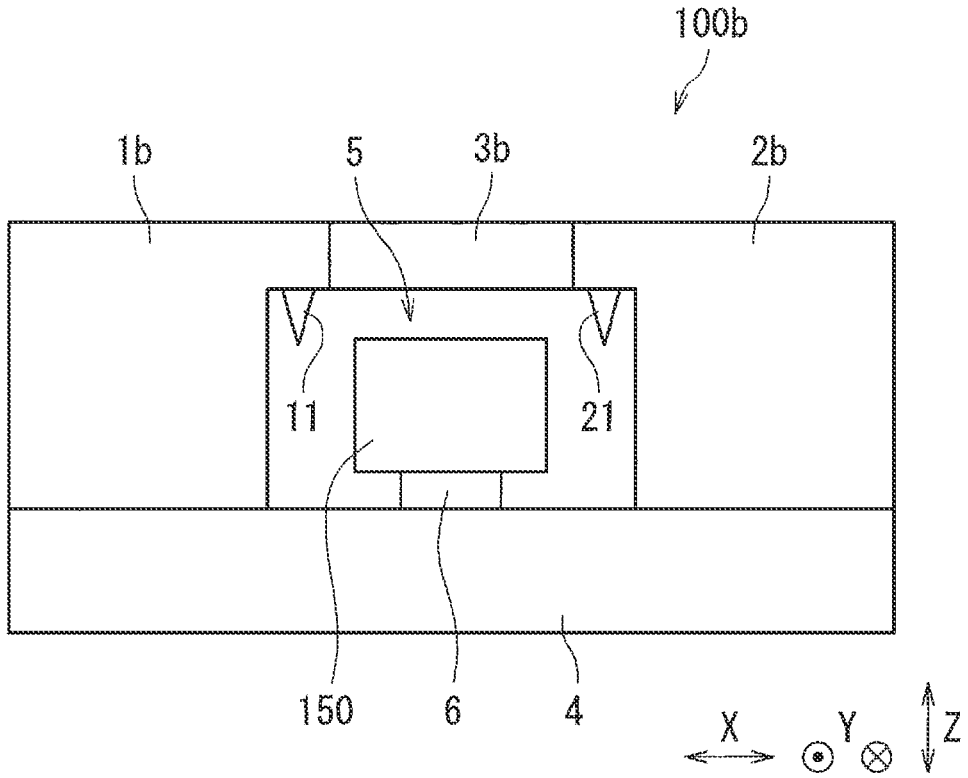
FIG. 13 is a schematic diagram illustrating a coating apparatus according to a second modified example of the embodiment.

The embodiment described above is directed to the example in which the coating robot 11 of the side unit 1 and the coating robot 21 of the side unit 2 are arranged on the sides of the coating area 5. The present disclosure is not limited to this example. As in a coating apparatus 100*b* of a second modified example illustrated in FIG. 13, a coating robot 11 of a side unit 1*b* and a coating robot 21 of a side unit 2*b* may be arranged on the upper side of the coating area 5. That is, the side unit 1*b* may be provided so that a robot arm of the coating robot 11 extends downward, and the side unit 2*b* may be provided so that a robot arm of the coating robot 21 extends downward. The air supply unit 3*b* may be interposed between the side units 1*b* and 2*b*.

Figure 14:
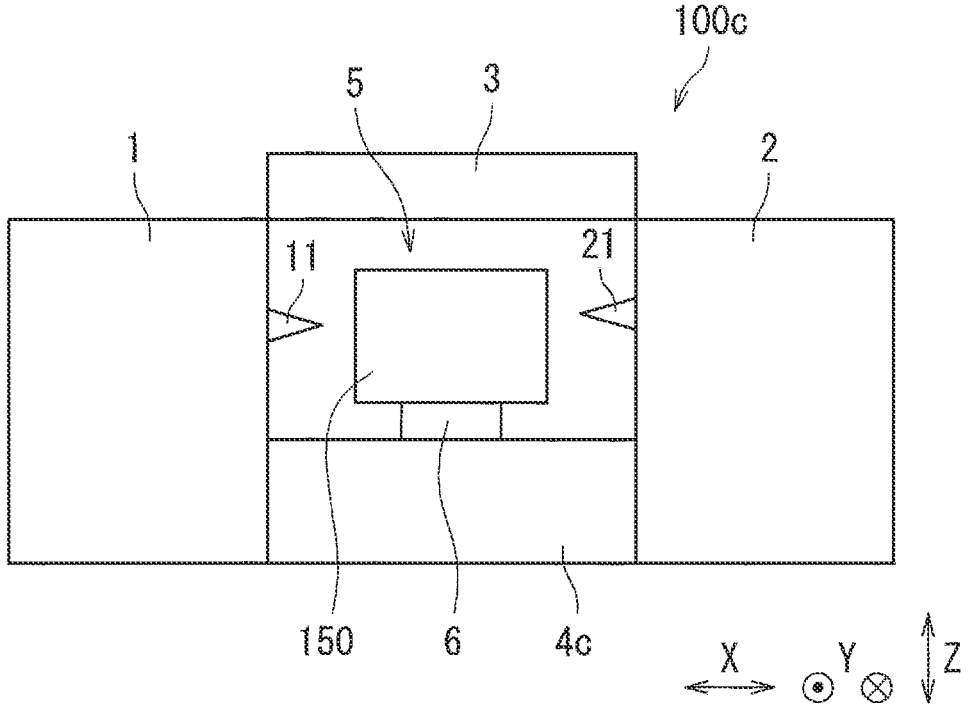
FIG. 14 is a schematic diagram illustrating a coating apparatus according to a third modified example of the embodiment.

The embodiment described above is directed to the example in which the air exhaust unit 4 is arranged below the side units 1 and 2. The present disclosure is not limited to this example. As in a coating apparatus 100*c* of a third modified example illustrated in FIG. 14, an air exhaust unit 4*c* may be interposed between the side units 1 and 2.

The embodiment described above is directed to the example in which the air discharger configured to discharge the shaping air is not provided in the coating robot 11 or 21. The present disclosure is not limited to this example. The air discharger configured to discharge the shaping air may be provided in the coating robot.

The embodiment described above is directed to the example in which air is released from the air exhaust chamber 42 to the outside via the air exhaust duct 8. The present disclosure is not limited to this example. The air may be returned from the air exhaust chamber to the air conditioner via the air exhaust duct.

The embodiment described above is directed to the example in which the air supply unit 3 and the air exhaust unit 4 are provided. The present disclosure is not limited to this example. The air supply unit or the air exhaust unit may be omitted, or both the air supply unit and the air exhaust unit may be omitted.

The embodiment described above is directed to the example in which the coating target 150 is moved relative to the coating apparatus 100. The present disclosure is not limited to this example. The coating apparatus may be moved relative to the coating target.

The embodiment described above is directed to the example in which the coating robots 11 and the control panel 13 are provided in the same side module 10*a*. The present disclosure is not limited to this example. The coating robots and the control panel may be provided in different side modules. The same holds true for the side unit 2.

In the embodiment described above, the coating material may be a water-based coating material or a solvent-based coating material.

The present disclosure is applicable to a coating apparatus and a method for installing the coating apparatus.

What is claimed is:

1. A coating apparatus comprising:

a first module constituting a coating area where a coating target is coated, the first module including a first frame;

a second module constituting the coating area where the coating target is coated, the second module including a second frame; and two third modules configured to be coupled to each other, wherein:

one of the third modules (i) is configured to be coupled to the first module, (ii) is coupled to be placed above, below, left or right of the first module when viewed in a cross section orthogonal to a movement path direction in which the coating target relatively moves along the coating area, and (iii) constitutes at least one of an air supply module configured to supply air to the coating area or an air exhaust module configured to exhaust air from the coating area:

the other one of the third modules (i) is configured to be coupled to the second module, (ii) is configured to be placed above, below, left or right of the second module when viewed in the cross section orthogonal to the movement path direction, and (iii) constitutes at least one of the air supply module or the air exhaust module;

when the first module and the second module are arranged to adjoin each other in the movement path direction, the first frame of the first module and the second frame of the second module that are arranged to adjoin each other are configured to be coupled together;

the one of the third modules includes a duct connector or a duct component, the duct connector being configured to connect to an air supply duct, the duct component constituting a part of an air exhaust duct;

the other one of the third modules does not includes the duct connector and the duct component; and at least one of the first module and the second module includes a coating robot.

2. The coating apparatus according to claim 1, wherein a control panel configured to control the coating robot is attached to a one of the first module or the second module, that includes the coating robot.

3. The coating apparatus according to claim 1, wherein the coating robot includes a spray gun configured to spray a coating material toward the coating target by electrostatically atomizing the coating material.

* * * * *